US006796863B1

(12) United States Patent
Oathout

(10) Patent No.: US 6,796,863 B1
(45) Date of Patent: Sep. 28, 2004

(54) PADDLE SUPPORT FOR A VESSEL

(76) Inventor: David E. Oathout, P.O. Box 518, Caroga Lake, NY (US) 12032

( * ) Notice: Subject to any disclaimer, the term of this patent is extended or adjusted under 35 U.S.C. 154(b) by 0 days.

(21) Appl. No.: 10/669,856

(22) Filed: Sep. 25, 2003

(51) Int. Cl.[7] ..... B63H 16/06
(52) U.S. Cl. ..... 440/104
(58) Field of Search ..... 440/104; 114/347

(56) References Cited

U.S. PATENT DOCUMENTS

| | | | |
|---|---|---|---|
| 88,013 | A | 3/1869 | Connor |
| 287,088 | A | 10/1883 | Beckers |
| 421,806 | A | 2/1890 | Bailey |
| 468,960 | A | 2/1892 | Vondersaar |
| 1,736,155 | A | 11/1929 | Harter |
| 2,033,637 | A | 3/1936 | Kaiser |
| 2,083,004 | A | 6/1937 | Clark |
| 2,299,178 | A | 10/1942 | Reiter |
| 2,550,625 | A | 4/1951 | Vick |
| 2,815,517 | A | 12/1957 | Andresen, Jr. |
| 3,347,060 | A | 10/1967 | Barkan |
| 3,898,950 | A | 8/1975 | Martin |
| 4,068,611 | A | 1/1978 | Leather |
| 4,266,707 | A | 5/1981 | Rossman |
| 4,290,156 | A | 9/1981 | Rawson |
| 4,380,208 | A | 4/1983 | Goserud |
| 4,516,941 | A | 5/1985 | Reid |
| 4,595,373 | A | 6/1986 | Giroux |
| 4,649,852 | A | 3/1987 | Piantedosi |
| 4,659,125 | A | 4/1987 | Chuan |
| 4,672,911 | A | 6/1987 | Hodgins |
| 4,809,352 | A | 2/1989 | Walker |
| 4,856,929 | A | 8/1989 | Smahlik et al. |
| 5,050,526 | A | 9/1991 | Nelson et al. |
| 5,059,145 | A | 10/1991 | Gregg |
| 5,127,859 | A | 7/1992 | Rantilla |
| 5,215,482 | A | 6/1993 | Henry |
| 5,435,093 | A | 7/1995 | Minorics et al. |
| 5,481,822 | A | 1/1996 | Engels |
| 5,595,517 | A | 1/1997 | Smith |
| 5,605,112 | A | 2/1997 | Schuman |
| 5,647,782 | A | 7/1997 | Henry |
| 5,685,750 | A | 11/1997 | Rantilla |
| 5,975,004 | A | 11/1999 | Nesseth |
| 6,022,255 | A | 2/2000 | Lukanovich |
| 6,052,939 | A | 4/2000 | McClain et al. |
| 6,068,402 | A | 5/2000 | Freese et al. |
| 6,083,066 | A | 7/2000 | Wright |
| 6,095,878 | A | 8/2000 | Van Balen |
| 6,183,325 | B1 | 2/2001 | Purser |
| 6,632,111 | B2 * | 10/2003 | Oathout ..... 440/104 |
| 6,645,025 | B2 * | 11/2003 | Oathout ..... 440/104 |

FOREIGN PATENT DOCUMENTS

| | | |
|---|---|---|
| AT | 166561 | 7/1948 |
| CH | 123262 | 11/1927 |
| DE | 164046 | 10/1905 |
| DE | 572423 | 2/1933 |
| DE | 3415483 | 4/1987 |
| FR | 2577512 | 8/1986 |
| FR | 2589125 | 4/1987 |
| GB | 6872 | 4/1893 |
| GB | 10242 | 5/1907 |
| GB | 304095 | 1/1929 |
| GB | 2101946 | 1/1983 |
| IT | 451657 | 9/1949 |
| NL | 8701897 | 3/1989 |
| NO | 72278 | 8/1946 |

* cited by examiner

*Primary Examiner*—Jesus D. Sotelo
(74) *Attorney, Agent, or Firm*—Oliff & Berridge, PLC

(57) ABSTRACT

A paddle support for a vessel, such as a kayak or canoe. The paddle support includes an upright support member of adjustable length and a retainer at the top portion of the upright support member for retaining a paddle. The upright support member has an elastic cord that allows the paddle to extend past a predetermined set height to allow a rower a greater range of operation motion, while allowing return to the predetermined set height upon release of an external force.

22 Claims, 6 Drawing Sheets

PADDLE SUPPORT FOR A VESSEL

BACKGROUND OF THE INVENTION

1. Field of Invention

This invention relates to a paddle support for a vessel to allow a rower to rest a paddle while rowing the vessel or while at rest. More particularly, the paddle support includes an elastic portion that allows extension of the support to accommodate reach or extension of the paddle position while also allowing return to a predetermined height.

2. Description of Related Art

The use of paddle supports and/or locks to assist in rowing a vessel is well known in the prior art. Typically, these devices provide support for an oar or a paddle and may also provide leverage to the rower during operation. These devices may be attached to the outer hull of the vessel, or they may be mounted on the floor of the vessel with a post that extends upward to engage a paddle or an oar at a height which facilitates the individual rower.

SUMMARY OF THE INVENTION

Paddle supports can be removably or permanently attached to a vessel during operation. This requires the paddle to be fixed in a position prior to operation. While this may provide the rower with both leverage and support, it also restricts the rower's range of motion when manipulating the paddle. If a rower accidentally removes the paddle from the support, he must then direct his time and attention to returning the paddle to the operating position within the support. Thus, these devices require the rower to make a conscious effort to return the paddle to the support before rowing may continue.

In addition, these devices do not allow the rower to reposition the support laterally without either removing and reattaching the support or making some other type of adjustment. Further, a rower may find it necessary from time to time to push the vessel away from fixed objects, such as rocks or peers, or to push debris away from the vessel itself In these situations, the necessity to remove and replace the paddle in the support may become problematic. This may be especially so when the vessel is moving rapidly through areas with many fixed objects, i.e., areas of rivers and streams containing rapids. Further, in other situations it may be necessary for the rower to shift his weight or move within the vessel in order to maneuver the vessel. For example, a rower maneuvering through an area of heavy surf in the ocean may need to lean forward or backward within the kayak to negotiate a wave. Likewise, the rower may also need to lean forward or backward when negotiating areas of rivers and streams containing rapids. In these situations, the ability of the rower to quickly and freely manipulate the paddle and adjust the reach of the paddle may be crucial in preventing injury to the rower as well as damage to the vessel. This is particularly true when the vessel is a kayak.

This invention provides an apparatus and method for supporting a paddle during operation of a vessel. The paddle support of this invention utilizes freestanding support sections that are telescopically attached to one another and removably attached to the paddle. The paddle support need not be attached to the vessel. This allows the rower to manipulate the paddle freely with the support attached. The paddle support is made up of a retainer at the top portion for retaining the paddle, an upright support section made up of telescopically connected support sections that may be adjusted or set to a proper height to facilitate the rower, and a base section that rests freely on the floor of the vessel. Further, in one exemplary embodiment, an elastic member can be located in a center of the separate support sections. The elastic member allows the rower to extend the paddle support beyond its overall length in various directions when the paddle support is attached to the vessel. This arrangement allows the paddle support to be manipulated either forward or laterally to facilitate the comfort of the rower, and to allow the rower to maneuver the paddle as necessary during operation. This is especially advantageous in situations involving fast moving water, such as rapids, or surf, and that the rower can quickly manipulate the paddle to push off of rocks and obstructions, or negotiate surf, returning just as quickly to rowing the vessel.

The paddle support of this invention may be adjusted in height to facilitate the comfort of the individual rower. This aids in reducing arm fatigue, by allowing the rower to operate the paddle in a range of motion which is most comfortable. It also allows the rower to rest the weight of the paddle in the rower's arms on the support during periods when the vessel is not being actively rowed.

In vessels such as canoes and kayaks, a rower may use a skirt to prevent water from entering the vessel. Typically, the skirt would cover the area between the rower's body and the edge of the inside of the vessel; for example, the exposed cockpit area of the kayak. Paddle support in the prior art are not particularly conducive for use with a skirt, because the support must either be attached a considerable distance from the rower's body, or must penetrate the skirt itself, creating a point where water may enter the vessel. In addition, because the supports of the prior art are in a fixed position and attached to the vessel itself, there is greater possibility of injury to the rower when operating in rough water conditions.

One exemplary embodiment of the current invention alleviates this condition, allowing for use of the paddle support with a skirt. In this embodiment, clamps may be removably attached to the rim of the cockpit area of a kayak. The clamps not only can support the paddle support but also can couple the paddle support and paddle to the vessel via elongated members. The clamps can be connected to a bottom portion of the paddle support via the elongated members. In addition, the clamps may allow for a quick release from the vessel when a predetermined force is applied. An example of this may be when the rower desires a quick exit from the vessel. On the other hand, when use of the clamps are not desired, the clamps can attach to the paddle support itself. This arrangement allows for compact storage of the paddle support.

The elongated members may be suspended across the cockpit area of a kayak or canoe when a skirt is utilized. The upright support portion of the paddle support may be located at the center portion of the vessel opening. When used in this manner, the clamps attach to the coaming or the edge of the vessel opening so as to provide tension across the elongated members with the base portion resting on the skirt. The elongated members may further be maintained in tension over the opening by a downward force exerted by the rower's arms, paddle, and paddle support all bearing down on the elongated members. In this way the support may be maintained close to the rower's body without interfering with a water tight skirt.

At least one of the elongated members may be provided with an extended portion to attach to the vessel. The extended portion acts as a back up leash in the event the clamps release from the vessel so that both the paddle support and paddle remain coupled to the vessel.

When the skirt is not used, the paddle support may alternatively rest on the bottom interior of the vessel or be suspended in tension across an opening above the base of the vessel via the elongated members and clamps.

Moreover, the base portion of the paddle support may also have a contact area of a material with a friction coefficient sufficient to reduce slippage. The contact area assists in providing a stable environment for using the paddle support, for example when the paddle support is placed on the bottom interior of the vessel.

In addition, an elastic member can be located within the central portion of the paddle support. The elastic member allows the rower to freely move the paddle such that he may extend the paddle past the overall length of the paddle support in an extended position and allowing the paddle to quickly return to the retracted rest position. The elastic member maintains the integrity of the paddle support by maintaining a connection between the retainer and the rest of the paddle support. In a preferred embodiment, the elastic member is located within the upper and lower support sections of the paddle support. One end of the elastic member is affixed to a lower portion of the lower support section while the opposing end is attached to the retainer at the upper portion of the upper support section. The arrangement and number of elastic members may vary. For example, the elastic member may be attached to an upper portion of the upper support section instead of the lower support section so as to allow greater mobility without having the upper and lower support sections from coming apart. Alternatively, the elastic member may also be non-elastic as long as the paddle is allowed to move past the set height when greater mobility is desired. However, this may not result in the ability to automatically return to the predetermined height. Thus, a greater freedom of movement may be achieved by virtue of the elastic member contained on the paddle support.

The height of the support may be varied by adjusting the overall length of the elongated member suspended over the opening and or adjusting the height of the paddle support itself. In various exemplary embodiments, the upper support section has holes for adjusting the height of the paddle support. The upper support section slidably fits within the lower support section. In a preferred embodiment, the upper support section has a plurality of predetermined spaced apart holes for height adjustment. A flexible plug is inserted into a hole for the desired height. Then, with the weight of the rower's arms and paddle bearing down on the paddle support, the upper section is pushed down within the lower section. When this occurs, the flexible plug is wedged between the upper and lower support sections so as to lock the paddle support from moving in a vertical direction and rotating about the longitudinal axis of the upper and lower support sections.

In another preferred embodiment for setting the height of the paddle support, a rigid plug member is provided. The plug member fits into the holes of the upper support section to allow the rower to adjust the overall height of the paddle support based on the location of the plug in the particular hole in the upper support section. The plug member in this embodiment prevents the upper support section from sliding further downward within the lower support section, while allowing the upper support section to rotate about the longitudinal axis of the upper support section. In this arrangement, the plug member provides the rower greater mobility by allowing the upper support section to move in an upward vertical direction when desired and to return to the set height via the elastic member.

Furthermore, the paddle support may be manufactured from any material that is lightweight to allow the paddle support to float in the water. In addition, the paddle support may be of any color that will allow for easy detection in the water.

Lastly, the apparatus and method of this invention allows for easy removal and storage of the paddle support. This in turn, facilitates the easy handling and transporting of the vessel, and that the entire paddle support apparatus is removed from the vessel leaving no outward projections which could hinder mounting and transporting on a vehicle.

These and other features and advantages of this invention are described in, or are apparent from, the following Detailed Description of Preferred Embodiments.

BRIEF DESCRIPTION OF THE DRAWINGS

The invention will be described with reference to the accompanying drawings in which like elements are labeled with like numbers, and in which.

DETAILED DESCRIPTION OF PREFERRED EMBODIMENTS

Figure 1:
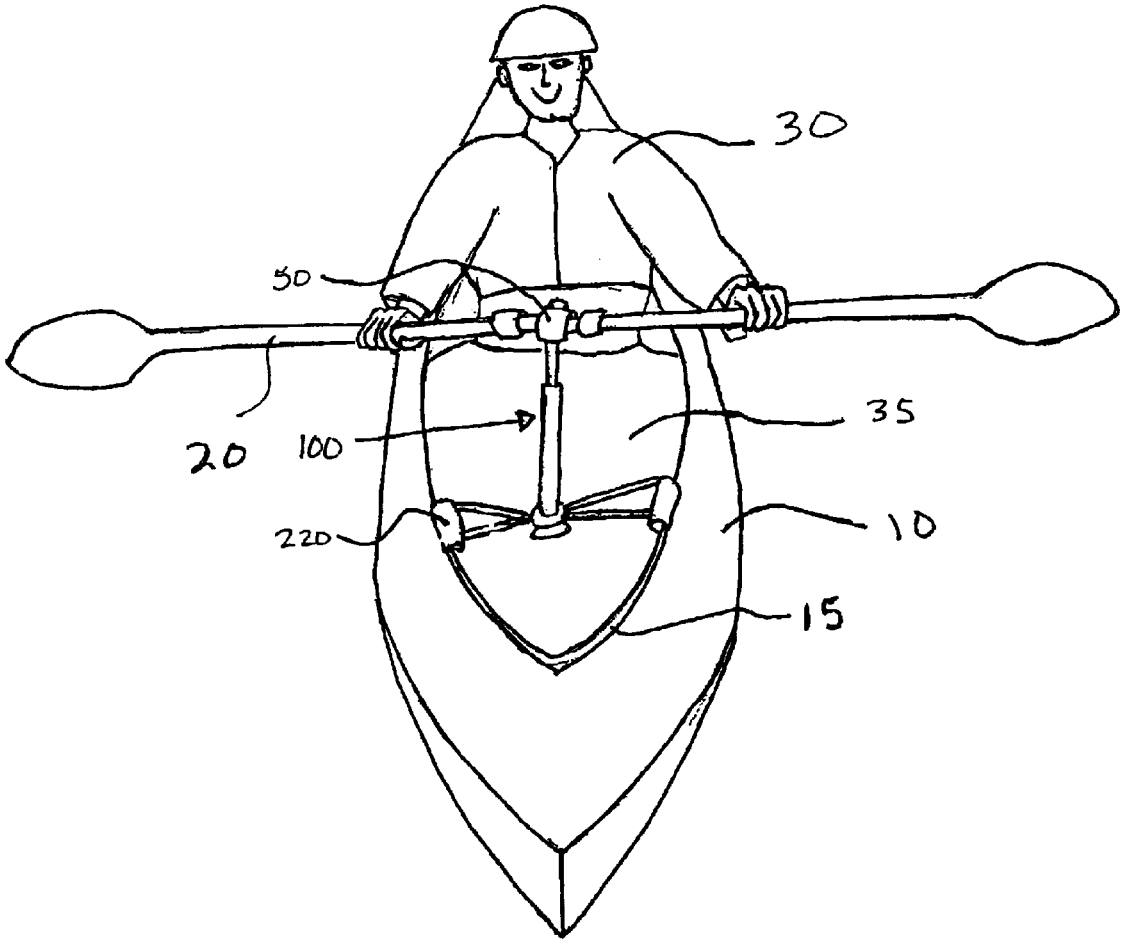
FIG. 1 shows an exemplary embodiment of a typical vessel with rower, paddle, skirt and paddle support according to this invention.

FIG. 1 shows an exemplary embodiment of the paddle support 100. The paddle 20 is mounted to the top of the paddle support 100 by a retainer 50 at the upper portion of the paddle support 100. The lower portion of the paddle support 100 is placed on top of skirt 35 while clamps 220 attach to both the skirt 35 and the coaming or rim 15 of the vessel 10. With this arrangement water is prevented from entering the vessel 10 and also allowing the rower 30 to manipulate the paddle 20 in a full range of operational motion. The weight of the paddle 20 and the rower's arm on the paddle support 100 is ultimately distributed to the vessel 10.

Figure 2:
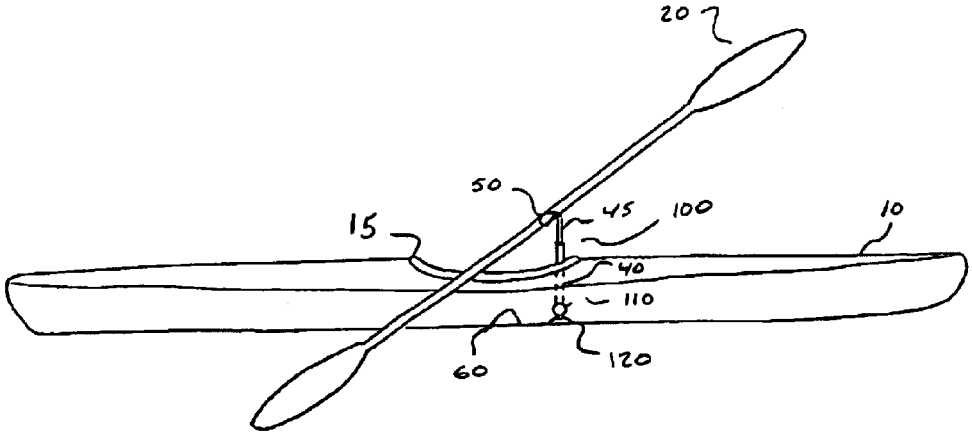
FIG. 2 is another exemplary embodiment of a vessel paddle and paddle support of this invention.

FIG. 2 is another exemplary embodiment of a vessel, paddle and paddle support of this invention. A longitudinal view of a typical vessel 10 is shown with the paddle support 100 shown in place resting on the interior bottom or base 60 of the vessel 10. In this embodiment, the paddle support 100 is made up of a lower section 40 and an upper section 45. However, it should be appreciated that in various exemplary embodiments, the paddle support 100 of this invention may be made up of an individual section or several sections without departing from the scope of the invention. The paddle support 100 has a lower ball section 100 connected to a base section 120 that rests on the bottom of the vessel 60. According to one exemplary embodiment of the paddle support 100 of this invention, the base section 120 may be a suction cup. In other exemplary embodiments, the base section 120 may be a flat or rounded member that allows the paddle support to simply rest freely on the bottom of the vessel 60. In this embodiment, the paddle support 100 is not attached to the vessel in anyway. This allows the rower to freely manipulate the paddle 20 with the paddle support 40 connected in anyway necessary without the encumbrance of having the paddle 20 physically attached to the vessel 10. The vessel 10 has a rim 125 that may be used to connect the paddle support 100 to the vessel 10. Those skilled in the art should recognize that the paddle support 100 may be used with a wide variety of vessels, and is not limited to the exemplary vessels shown.

Figure 3:
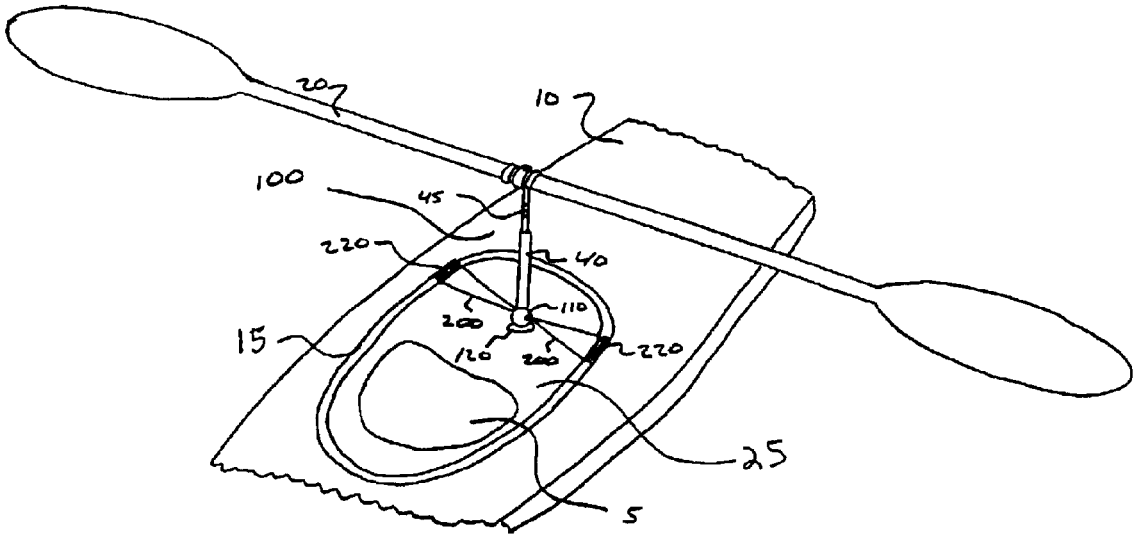
FIG. 3 is an exemplary embodiment of the paddle support of this invention suspended over the opening of a vessel by an elongated member.

FIG. 3 is an exemplary embodiment of the paddle support of this invention suspended over the opening of a vessel by an elongate member. As illustrated, paddle 20 is attached to the upper portion of paddle support 100. In this embodiment, the paddle support 100 is suspended above seat portion 5 and over opening 25 of vessel 10 by the elongated members 200 which are attached to the rim 15 via clamps 220. By adjusting the upper section 45 relative to the lower section 40, the paddle support 100 may be placed in a desired position by the rower 30. This also allows room for the rower's legs to fit below the elongated members 200. In this manner, the weight of the paddle 20 and paddle support 100 may be supported by the rim 15 of the vessel 10. The elongated members 200 may be of a flexible material that allows the paddle support 100 to rotate freely from the point of connection at the lower ball section 110.

Figure 4:
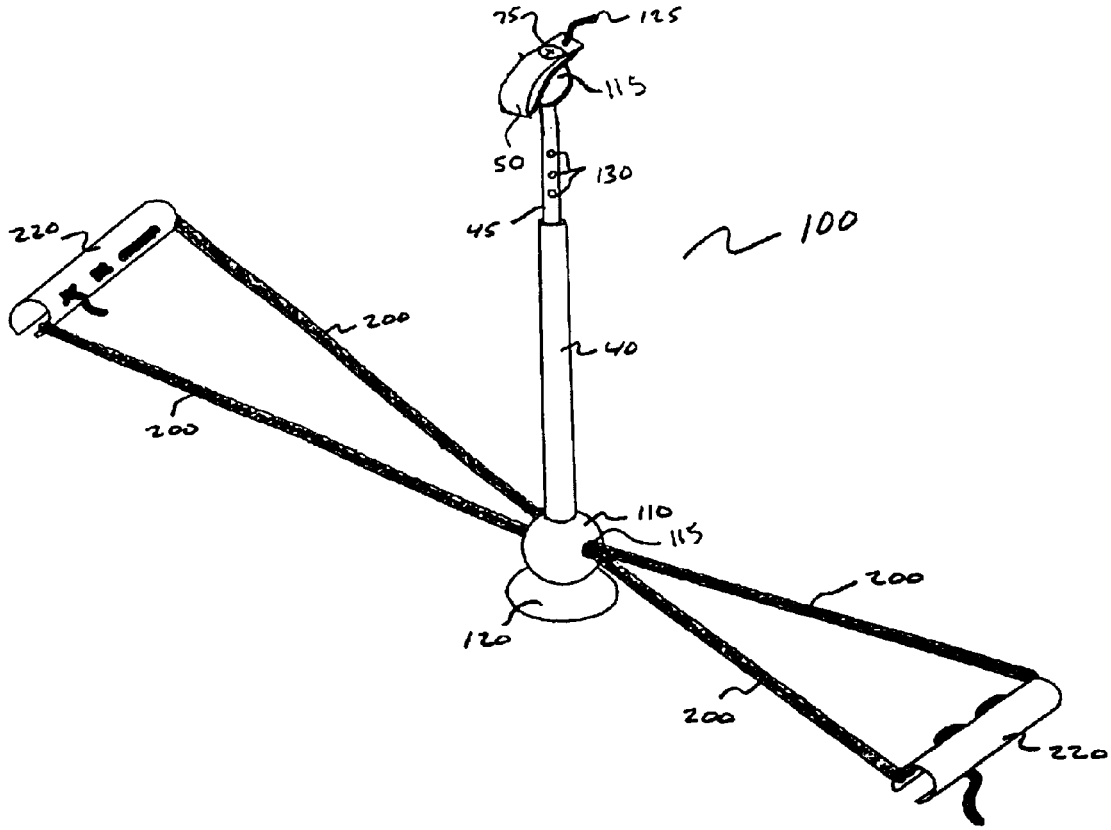
FIG. 4 is an exemplary embodiment of the paddle support of this invention having an elongated member attached at the basis of the support for suspending the device over the opening of a vessel.
Figure 5:
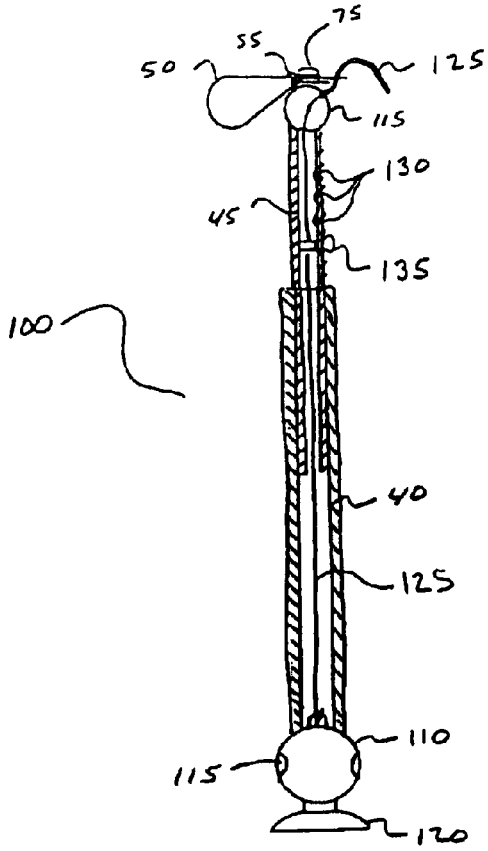
FIG. 5 is a cross-sectional view of an exemplary embodiment of a telescoping paddle support according to this invention.

FIG. 4 is an exemplary embodiment of a paddle support according to this invention. As illustrated, paddle support 100 comprises a lower section 40 and upper section 45 that are telescopically connected. The upper section 45 has a plurality of spaced a part holes 130 for positioning the upper section 45 relative to the lower section 40 in order to adjust the paddle support 100 to the proper height for the rower 30. Upper ball section 115 is connected to the top of the upper section 45. Upper ball section 115 may also accommodate elastic member 125 (not shown). Attached to the upper ball section 115 is the retainer 50 for holding a paddle 20 (now shown). The retainer 50 is fastened to the upper ball section by fastener 55 as shown in FIG. 5. The fastener 55 may be in the form of a screw or any other suitable type connecting means, such as a pin, bolt, nut, rod, hook and loop type fastener etc. In the embodiment of FIG. 4, a compass 75 is mounted to the top of the retainer 50. However, in other exemplary embodiments, a clock, light or other such device may be mounted in lieu of a compass 75. In addition, the compass 75 may be mounted at other portions of the paddle support 100 without departing from the scope of the invention.

The lower section 40 is connected to lower ball section 110. Lower ball section 110 has a flexible portion that allows the paddle support 100 to pivot about lower ball 110. Also lower ball 110 has ball opening 115 that accommodates elongated members 200. The elongated members 200 pass through ball opening 115 and have at opposing ends clamps 220. As mentioned above clamps 220 may be fastened to the rim or coaming 125 of vessel 10. When a sufficient amount of tension is supplied to the elongated members 200, paddle support 100 may suspend over opening 25 of vessel 10 as shown in FIG. 3. Clamps 220 remain fixed to rim 125 but when a predetermined amount of force is applied, for example when rower 30 desires a quick exit, at least one of clamps 220 may easily release from the rim 125. Lower section 40 has base 120 that is connected to lower ball section 110 is also connected to base 120. Base 120 may be a flat or rounded member for resting the paddle support 100 on base 60 of vessel 10 as depicted in FIG. 2 or on skirt 35 as shown in FIG. 1. Base 120 may alternatively be in the form of a suction cup for temporarily attaching the paddle support 100 to base 60 or skirt 35. The elongated members 200 may be in the form of ropes, or can be manufactured from any suitable material such as plastic or elastic material. In addition, the clamps 220 may be flexible to facilitate attachment to the rim of the vessel, or they may be of a rigid material and tightened into place by adjusting the elongated members 200. The elongated members may also be adjusted in length by the rower 30 to facilitate a desired placement of the paddle support 100 within the vessel 10.

Figure 6:
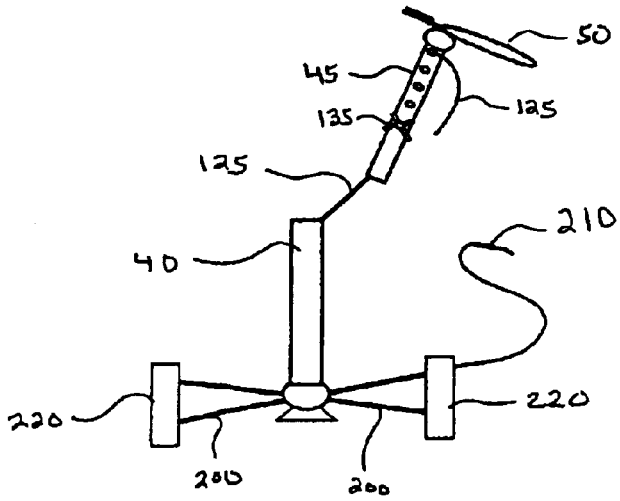
FIG. 6 is an exemplary embodiment of the paddle support shown in an extended position.

FIG. 5 is a cross-sectional view showing the telescoping connection of upper and lower support sections of a paddle support according to this invention. As illustrated, upper section 45 and lower section 40 are telescopically connected such that upper section 45 freely moves within lower section 40. The plurality of holes 130 located in upper section 45 accommodate plug 135 so as to allow the rower 30 to adjust upper section 45 to a desired height. An elastic member 125 has opposing ends that each respectively attach to upper section 45 and lower section 40. This arrangement allows the elastic member 125 to provide tension to urge the upper section 45 towards the lower section 40. In this way the elastic member 125 allows a rower 30 to extend the paddle support 100 as depicted in FIG. 6 and then return to the set height position. The rower may also set the desired tension by adjusting elastic member 125 between upper section 45 and lower section 40. Elastic member 125 allows a greater range of motion for rower 30 to manipulate a paddle 20 during use.

Alternatively, the elastic member 125 need not be attached to the lower support section 40. The elastic member 125 may instead be attached to the upper support section 40 at one end and the other end attached to retainer 50. In this way the rower 30 will still be allowed a desired range of motion by allowing paddle 20 to be lifted off of the paddle support 100. In this arrangement upper support section 45 and lower support section 40 need not separate as shown in FIG. 6.

FIG. 6 also shows leash 210 extending from clamp 220. Leash 210 may be an extension of elongate member 200 and tethered to vessel 20. If vessel 20 is capsized paddle support 100 and paddle 20 are prevented from drifting away from the vessel 20. Alternatively, leash 210 may be used to retain the paddle support 100 in place when clamps 220 are fixed to rim 125. To accomplish this, leash 210 may be wrapped around the rim 125 of vessel 10 so as to go around and behind rower 30 and tethered to the opposing clamp 220. This additionally prevents clamps 220 from sliding along the rim 125.

Figure 7:
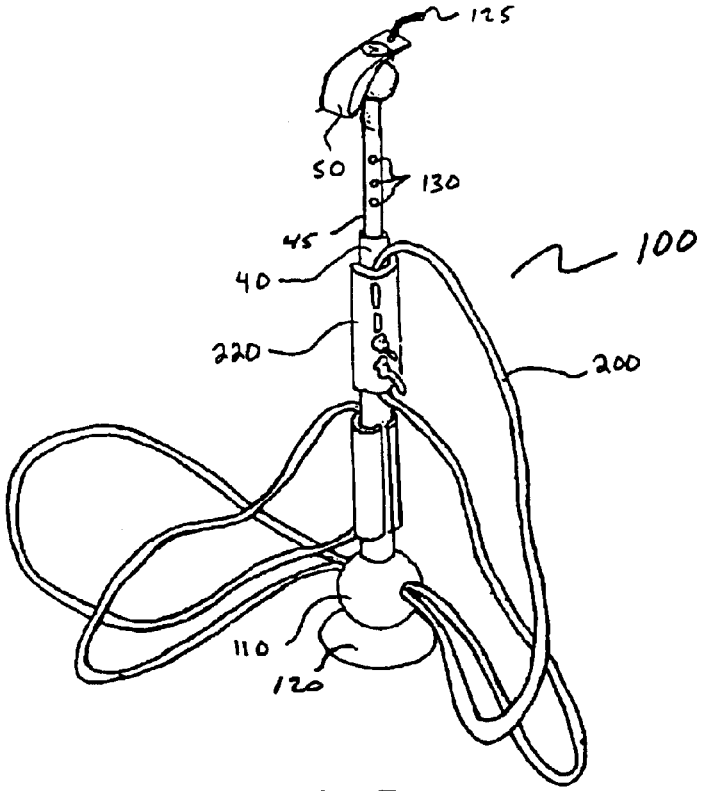
FIG. 7 is an exemplary embodiment of this invention showing the clamps attached to the paddle support.

FIG. 7 shows the embodiment of the paddle support of FIG. 4. In this view clamps 220 are retained on the lower support section 40. This allows the paddle support 100 to be more compact for storage and also allows the rower 30 the option of not utilizing clamps 220 when using the paddle support 100 in the manner shown in FIG. 2.

Figure 8:
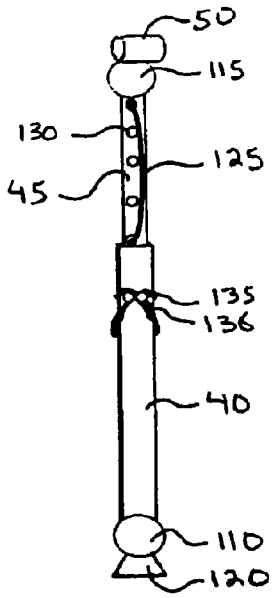
FIG. 8 is an exemplary embodiment of the paddle support showing an embodiment of the locking mechanism.

FIG. 8 shows an exemplary embodiment of a locking mechanism for the paddle support. In this view an extra length of elastic member 125 or any other elastic member extends from the upper area of paddle support 100. The extra length of elastic member 125 is then fed into one of the plurality of holes 130 depending on the desired height for the paddle support 100. A force is then applied to the paddle support 100 so that the upper support section 40 slides to the desired height. The extra length of elastic member 125 is then wedged or pinched between upper and lower sections 40 and 45. The extended portion of elastic member 125 locks or sets the paddle support to the desired height. Also, the wedging of the extended portion 125 prevents upper support section 45 from rotating within lower support section 40. However, when a predetermined upward force is applied, the upper support section 45 telescopingly extends to allow for a greater range of motion. When the rower 30 desires to return the paddle 20 to the set height the elastic member 125 provides a sufficient amount of tension to return the upper support section 45 within lower support section 40 to the predetermined set height.

Figure 9:
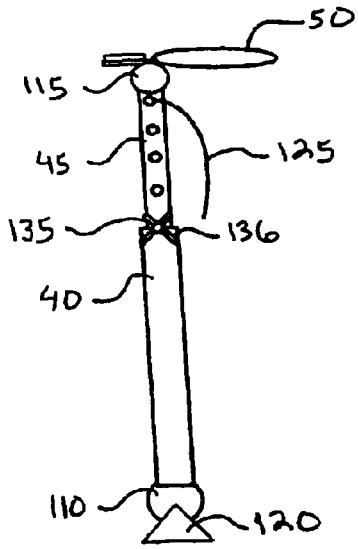
FIG. 9 is another embodiment of the locking mechanism.

Instead of using the extended portion of elastic member 125 to set the height of the paddle support 100, a plug 135 may be inserted into hole 130 in order to set the upper section 45 at the proper height relative to the lower section 40 as shown in FIG. 9. Plug 135 may be kept in place with an elastic band 136 that wraps around the upper section 45, or may be maintained in the hole via an interference fit. Elastic band 136 allows the plug 135 to be retained on either the upper support section 45 or lower support section 40. In this embodiment, upper section 45 is allowed to rotate about lower section 40.

Figure 10:
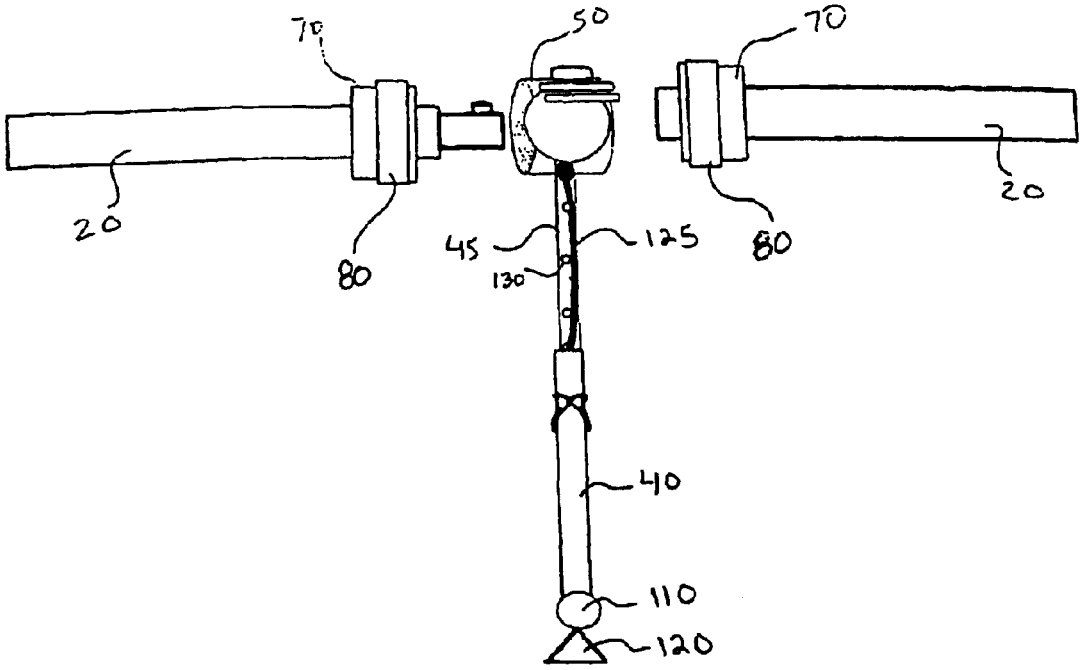
FIG. 10 is an exemplary embodiment of a retainer and bushing for maintaining a paddle on a paddle support.

FIG. 10 is an exemplary embodiment of an elastic strap 80 and bushing 70 in place on a detachable paddle 20. As illustrated, bushing 70 are located on opposite sides of retainer 50. Bushings 70 are circular "C" shaped rings. The "C" shape allows bushings 70 to deflect to accommodate various paddle shaft diameters and attach around the shaft of paddle 20. The bushings may also be made be of any material that will deflect to the shape of the various paddle diameters. Elastic straps 80 are then placed over the bushings 70 in order to maintain the bushings 70 in place on either side of the retainer 50. This arrangement allows the rower 30 to position the paddle 20 in a desired location on top of the paddle support 100 and prevents the paddle 20 from sliding in either direction relative to the retainer 50 during rowing.

For use with a non-detachable paddle 20 retainer 50 is un-strapped from paddle support 100 and then strapped around the desired area along the shaft of paddle 20. As mentioned above bushing 70 are positioned on opposite sides of the retainer 50 along the paddle shaft to retain the paddle 20 in the desired position and to prevent the paddle 20 from sliding out of the retainer 50. Further, any means may be used to prevent bushing 70 from sliding out the shaft of paddle 20. For example, an elastic strap or adhesive tape may be used to retain bushing 70 to a desired position.

Figure 11:
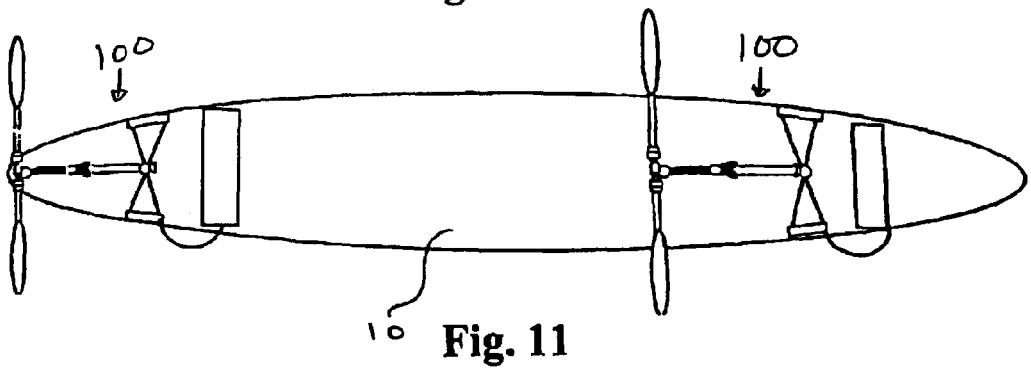
FIG. 11 is an exemplary embodiment of the paddle support on a canoe.
Figure 12:
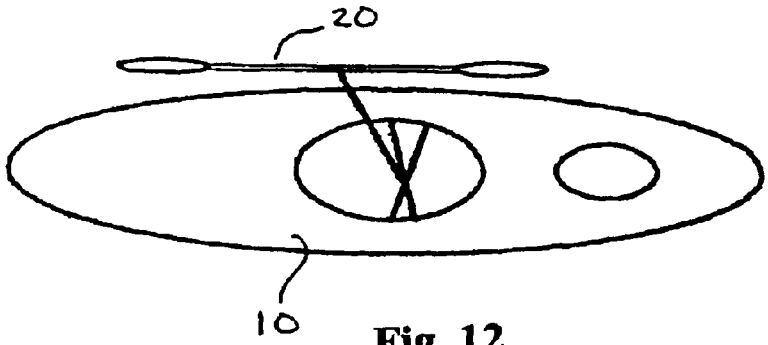
FIG. 12 is an exemplary embodiment of the paddle support attached to a kayak.

FIGS. 11 and 12 show the versatility of the paddle support 100. FIG. 11 shows two paddle supports 100 being used with a canoe. FIG. 12 shows a single paddle support 100 being used with a kayak.

While this invention has been described in conjunction with specific embodiments outlined above, it is evident that many alternatives, modifications and variations will be apparent to those skilled in the art. Accordingly, the preferred embodiments of the invention as set forth above, are intended to be illustrative, not limiting. Various changes may be made without departing from the spirit and scope of the invention.

What is claimed is:

1. A kayak paddle support for a vessel, comprising:

an upright support member of adjustable length;

a retainer at a top portion of the upright support member for retaining a paddle while allowing the paddle to be manipulated in a range of operation motion;

an elastic member connected to the retainer and the upright support member to allow the paddle a greater range of motion by allowing the paddle to extend past the overall length of the upright support member; and an elongated member connected to the upright support member, and the elongated member having clamps at opposing ends for attaching to the vessel.

2. The paddle support according to claim 1, wherein the upright support member includes at least an upper and a lower support member.

3. The paddle support according to claim 2, wherein the upper and lower support members are hollow tubing so that the upper support member slidably fits within the lower support member.

4. The paddle support according to claim 3, wherein the upright support member has a device for adjusting the height between the upper and lower support members.

5. The paddle support according to claim 3, wherein the elastic member having opposing first and second ends is connected to an upper portion of the upper support member at the first end and connected to a lower portion of the lower support member at the second end.

6. The paddle support according to claim 1, wherein the upright support member has a base portion.

7. The paddle support according to claim 6, wherein the base portion is slidably connected with the elongated member.

8. The paddle support according to claim 6, wherein the base portion is located at the bottom end of the upright support member and the base portion allows the upright support member to pivot about the base portion.

9. The paddle support according to claim 6, wherein the base portion has a suction cup portion for attaching to a surface.

10. The paddle support according to claim 1, wherein the clamps are slidably adjustable along the elongate member.

11. The paddle support according to claim 10, wherein the upper support member has a plurality of holes spaced along the longitudinal axis of the upper support member.

12. The paddle support according to claim 11, wherein the mechanism for adjusting the height is a plug that is inserted into one of the plurality of holes to fix the upper support member to a predetermined height via the tension within the elastic member.

13. The paddle support according to claim 5, wherein the elastic member causes the upper and lower support member to be biased toward one another in a retracted predetermined position, allows the upper support member to extend past the lower support member to an extended position upon application of a sufficient external force, and then causes automatic return of the upper and lower support members to the retracted position upon release of the external force.

14. The paddle support according to claim 1, further comprising a leash that attaches the vessel and paddle support to one another.

15. The paddle support according to claim 14, wherein the leash has opposing ends, wherein one of the opposing ends is fixed to one of the clamps and the other opposing free end is releasably attachable to a second one of the clamps.

16. A method of using the paddle support of claim 1, comprising mounting the paddle support on a skirt of the vessel.

17. A method of using the paddle support of claim 1, comprising mounting the paddle support on an inner bottom surface of the vessel.

18. A method of using the paddle support of claim 1, comprising attaching the clamps to a rim of a vessel opening so that the paddle support is suspended across the vessel opening.

19. A method of using the paddle support of claim 15, comprising:

mounting the paddle support clamps to the vessel;

wrapping the position free end of the leash around a rear portion of a vessel opening behind a user; and attaching the free end of the leash to the second clamp.

20. A kayak paddle support for a vessel, comprising:

an upright support member of adjustable length that is fixable at a predetermined height;

a retainer at a top portion of the upright support member for retaining a paddle while allowing the paddle to be manipulated in a range of operation motion;

an elastic member connected to the retainer and the upright support member to bias the retainer and the upright support member towards each other and allow the paddle a greater range of motion by allowing the paddle to extend past a predetermined set height of an elastic member connected to the retainer and the upright support member to bias the retainer and the upright support member towards each other and allow the paddle a greater range of motion by allowing the paddle to extend past a predetermined set height of the upright support member upon application of sufficient external force, and allow return of the paddle to the predetermined set height upon release of the external force; and an elongated member connected to the upright support member, and the elongated member having clamps at opposing ends attachable to the vessel.

21. The paddle support according to claim 20, wherein the upright support member includes at least an upper and a lower support member.

22. The paddle support according to claim 21, wherein the upper and lower support are telescopic.

* * * * *